United States Patent [19]

Youtz

[11] Patent Number: 4,828,484

[45] Date of Patent: May 9, 1989

[54] GAS VALVE RELAY REDUNDANT SAFETY

[75] Inventor: Stephen E. Youtz, Wayne, Ind.

[73] Assignee: Hamilton Standard Controls, Inc., Farmington, Conn.

[21] Appl. No.: 95,504

[22] Filed: Sep. 10, 1987

[51] Int. Cl.[4] ..... F23Q 23/00

[52] U.S. Cl. ..... 431/24; 431/30; 431/18; 431/26; 431/29

[58] Field of Search ..... 431/15, 16, 17, 24, 431/22, 18, 29, 30, 31, 26

[56] References Cited

U.S. PATENT DOCUMENTS

| | | | |
|---|---|---|---|
| 3,954,383 | 5/1976 | Bryant | 431/24 |
| 3,958,126 | 5/1976 | Bryant | 431/24 X |
| 4,298,334 | 11/1981 | Clark et al. | 431/24 |
| 4,395,224 | 7/1983 | Cade | 431/31 |
| 4,496,305 | 1/1985 | Bentz | 431/19 X |
| 4,695,246 | 9/1987 | Beilfoss et al. | 431/31 |

*Primary Examiner*—Samuel Scott
*Assistant Examiner*—Carl D. Price

[57] ABSTRACT

A fail safe redundancy circuit for controlling a gas valve relay in a gas fired furnace or similar burner is disclosed. The status of the relay contacts is monitored and if those contacts are in the position for enabling the gas valve prior to an ignition attempt, a gate is enabled to shunt the control side of a circuit breaking device such as a fuse to overload that device causing it to kick out or open and interrupt power to the circuit thus disabling the burner. The burner combustion chamber is purged of any accumulated gas after the circuit breaker has been opened.

12 Claims, 1 Drawing Sheet

GAS VALVE RELAY REDUNDANT SAFETY

SUMMARY OF THE INVENTION

The present invention relates generally to electronic controls for burners, furnaces and the like, and more particularly to an integrated control for such burners in the illustrative environment of a gas-fired furnace.

Older furnace control systems have taken a modular approach with separate controls for functions such as gas ignition, a blower fan, the gas valve or valves, induced draft sensing, and thermostat setback operations. The integrated furnace control has taken all of the furnace control functions and combined them with the thermostat setback function into one main control module. The combining of all these functions into one complete module has made the system more cost effective than using separate components, allows many additional features, and provides a safer control.

The gas flow control valve or valves in such burners are typically controlled by one or more relays which when energized closes a set of contacts opening the corresponding gas valve. The reliability of these relays, when operated within their specifications, has been sufficiently satisfactory, however, in the event of operation outside those specifications, for example, beyond their contact life or in the event of a power surge as might be caused by an electrical storm or a downed power line, the relay contacts could weld or stick in the closed gas valve enabling position. One the next call for heat, the gas valve would open prematurely and excessive gas could build up in the combustion chamber prior to an ignition attempt. An explosion rather than simple ignition could result.

In U.S. Pat. No. 4,078,879 there is disclosed a furnace control system which emphasizes total fuel shutoff and contact protection. This patented arrangement relies on inhibition of a pulse generator in the event that the contacts are sensed as being prematurely closed. A fuse is present in this patented arrangement, but that fuse is not relied on in any extraordinary manner. Should a silicon controlled rectifier which controls the gas valve relay coil fail, the silicon controlled rectifier passes full rather than half-wave current, overloading and blowing the fuse.

In copending applications Ser. No. 095,508 and Ser. No. 095,506 each assigned to the assignee of the present application, entitled INTEGRATED FURNACE CONTROL AND CONTROL SELF TEST in the names of Mierzwinski, Grunden and Youtz and INTEGRATED FURNACE CONTROL HAVING IGNITION AND PRESSURE SWITCH DIAGNOSTICS in the names of Grunden, Youtz and Mierzwinski respectively, each filed on even date herewith, there are disclosed companion integrated furnace control systems sharing many features and adapted to incorporation on the present invention. The entire disclosures of those applications is specifically incorporated herein by reference.

Among the several objects of the present invention may be noted the provision of a versatile and economical integrated furnace control system of enhanced safety; the provision of a furnace control system which interrogates certain furnace components and checks for receipt back of a proper response; the provision of a furnace control system in accordance with the previous object which specifically checks the status of the gas valve relay contacts prior to an ignition attempt and precludes that attempt should the contact be in the gas valve enabling position; the provision of a furnace control system in accordance with the previous object which provides air flow to purge the combustion chamber of gas in the event the gas valve contacts are sensed to be in the wrong position; the provision of a circuit which blows its own fuse should a potentially dangerous condition be sensed; and the enhancement of overall safety in a fuel burner.

In general, an integrated burner control for a gas burner of the type having at least one gas valve control relay having a set of normally open contacts which are closed upon command from the integrated burner control to open a gas valve and supply gas to a burner combustion chamber, and an inducer fan for supplying air to the burner combustion chamber has a first circuit operable prior to each attempt at burner ignition for interrogating the control relay to determine whether the normally open contacts are open or closed, and a second circuit which is enabled by an indication from the first circuit that the control relay contacts are closed for disabling the burner. The second circuit comprises a circuit breaking device in circuit with a power supply to the burner control and an arrangement for overloading the circuit breaking device in response to an indication from the second circuit that the contacts are closed. The furnace inducer fan is operable independent of the circuit breaking device and in response to an indication by the second circuit that the contacts are closed, the system enables the inducer fan to purge the burner of gas. The circuit breaking device may comprise a fuse or other circuit interrupting device.

Also in general and in one form of the invention, a burner control for a gas burner of the type having at least one gas valve control relay having contacts and operable upon command from the burner control to open a gas valve and supply gas to a burner combustion chamber includes an arrangement operable prior to each attempt at burner ignition for interrogating the control relay to determine the state of the contacts, and a further arrangement enabled by an indication that the control relay contacts are in a position to enable the gas valve for disabling the burner. The further arrangement comprises a circuit breaking device in circuit with a power supply to the burner control and, in particular, to the gas valve itself, along with a device for overloading the circuit breaking device in response to an indication that the contacts are in a position to enable the gas valve.

BRIEF DESCRIPTION OF THE DRAWING

The drawing illustrates, in block diagram form, one circuit for overloading a fuse and disabling a burner in the event of a sensed dangerous condition.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
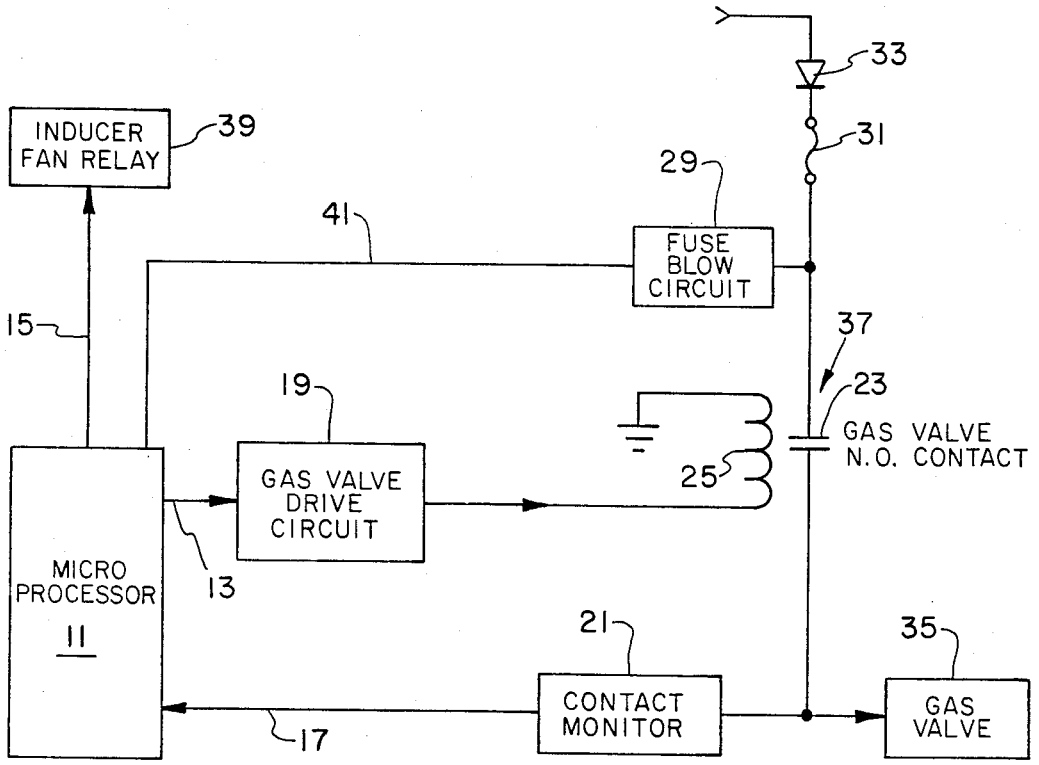

Referring to the drawing, a microprocessor 11, for example, of a type disclosed in either of the aforementioned copending applications has numerous furnace control outputs including, among others not illustrated, output line 15 for enabling an inducer fan to force air through the furnace combustion chamber, and output line 13 connected to a gas valve relay drive circuit 19. The microprocessor receives information on line 17 from a contact monitoring circuit 21. The contact monitoring circuit provides the microprocessor with information on the open or closed status of the normally open contacts 23 of the gas valve relay. Should the microprocessor issue a command to the drive circuit 19 that the gas valve relay coil 25 is to be energized and at the same time the contact sensor 21 senses that relay contacts 23 are already closed, therefore a signal from microprocessor 11 enables the fuse blow circuit 29 to cause excessive current flow through circuit 29 and fuse 31 blowing the fuse and removing the power supply to the gas valve 35.

Thus, the integrated burner control is in a gas burner of the type having at least one gas valve control relay 37 having a set of normally open contacts 23 which are closed upon command from the integrated burner control on line 13 by way of the relay 37 to open a gas valve 35 and supply gas to a burner combustion chamber. There may be an inducer fan 39 for supplying air to the burner combustion chamber. The contact monitor 21 is operable at least for a time period prior to the signal on line 13 prior to each attempt at burner ignition for interrogating the control relay to determine whether the normally open contacts 23 are open or closed. Circuit 29 is enabled by an indication on line 41 that the control relay contacts are closed for disabling the burner by overloading the circuit breaking device 31 in response to an indication that the contacts are closed. Preferably, the inducer fan, if present, is operable independent of the circuit breaking device and the microprocessor 11 is responsive to an indication that the contacts are closed for enabling the inducer fan to purge the burner of gas. The circuit 29 for overloading the circuit breaking device may comprise a gate such as a silicon controlled rectifier which when enabled causes excessive current flow through the circuit breaking device from the power supply to ground. This shunting should occur through a current limiting resistor of a value selected to ensure the fuse or other type circuit breaking device is tripped while not allowing such a great current flow as to damage the silicon controlled rectifier or other circuit components. Should this safety system perform its intended function, the microprocessor would need to be reset and the fuse replaced.

Another specific embodiment of the circuit breaker actuating arrangement of the invention is shown in detail in the second abovementioned copending application. In that application, a gas valve relay is sensed to determine if the contacts have welded or stuck in the closed position. A 60 Hertz square wave is sent to the processor if the contacts are closed and a 5 volt direct current bias is applied when the contacts are open. If the gas valve relay contacts do weld in a closed position, the fuse which provides power to the gas valve through those closed contacts will be blown, thus closing the gas valve in a fail-safe manner. This is accomplished by a microprocessor output of 5 volts which triggers the gate of a silicon controlled rectifier. When on, the silicon controlled rectifier draws current from a source terminal through the fuse to ground which exceeds the fuse limit blowing the fuse.

From the foregoing, it is now apparent that a novel fail-safe arrangement for disabling a gas valve in the event the contacts controlling that valve are stuck in a closed position has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An integrated burner control for a gas burner of the type having at least one gas valve control relay having a set of normally open control relay contacts which are in a circuit adapted to be connected with a supply of power and are closed upon command from the integrated burner control to provide a conductive path and thereby open a gas valve and supply gas to a burner combustion chamber to attempt ignition of the burner, and an inducer fan supplying air to the burner combustion chamber, said burner control comprising:

first means operable prior to each attempt at burner ignition for interrogating the control relay to determine whether the normally open control relay contacts are open or are in a failed closed mode; and second means enabled by an indication from the first means that the control relay contacts are closed for disabling the burner, said second means including circuit breaking means connected in the circuit with said control relay contacts and means for actuating the circuit breaking means in response to an indication from the first means that the contacts are closed for directly disconnecting the conductive path with the power supply to disable the burner, said circuit breaking means being of a type other than said control relay contacts, whereby said circuit breaking means is incapable of failing to a conductive mode in like manner as said control relay contacts.

2. The integrated burner control of claim 1 wherein the inducer fan is operable independent of the circuit breaking means and further comprising means responsive to an indication by the first means that the control relay contracts are closed for enabling the inducer fan to purge the burner of gas.

3. The integrated burner control of claim 1 wherein the circuit breaking means comprises a fuse.

4. The integrated burner control of claim 1 wherein the means for actuating the circuit breaking means comprises a gate which when enabled causes excessive current flow through the circuit breaking means from the power supply to ground.

5. A burner control for a gas burner of the type having at least one gas valve control relay having control relay contacts and operable upon command from the burner control to open a gas valve and supply gas to a burner combustion chamber to attempt ignition of the burner, and an inducer fan for supplying air to the burner combustion chamber comprising:

first means operable prior to each attempt at burner ignition for interrogating the control relay to determine the state of the control relay contacts;

second means enabled by an indication from the first means that the control relay contacts are in a state to enable the gas valve for disabling the burner, said second means including circuit breaking means connected in circuit with a power supply to the burner control and means for actuating the circuit breaking means for disabling the burner in response to a said indication from the first means that the contacts are in said position to enable the gas valve, said circuit breaking means being of a type other than said control relay contacts, whereby said circuit breaking means is incapable of failing to a conductive mode in like manner as said control relay contacts; and wherein the inducer fan is operable independently of the circuit breaking means.

6. The burner control of claim 5 wherein the circuit breaking means comprises a fuse.

7. The burner control of claim 5 wherein the means for actuating the circuit breaking means comprises a gate which when enabled causes excessive current flow through the circuit breaking means from the power supply to ground.

8. A burner control for a gas burner of the type having at least one gas valve control relay having a set of normally open control relay contacts which are closed upon command from the burner control to open a gas valve and supply gas to a burner combustion chamber to attempt ignition of the burner and wherein the gas valve is connected in series with a circuit breaking means to a power source, the burner control comprising circuitry for sensing the status of the relay contacts prior to burner ignition and for actuating the circuit breaking means in the event the contacts are sensed to be closed, said circuit breaking means being of a type other than said control relay contacts, whereby said circuit breaking means is incapable of failing to a conductive mode in like manner as said control relay contacts.

9. The burner control of claim 8 wherein the circuit breaking means comprises a fuse.

10. The burner control of claim 8 wherein the circuitry for actuating the circuit breaking means comprises a gate which when enabled causes excessive current flow through the circuit breaking means from the power source to ground.

11. A burner control for a gas burner of the type having at least one gas valve control relay having control relay contacts and operable upon command from the burner control to open a gas valve and supply gas to a burner combustion chamber to attempt ignition of the burner comprising:

first means operable prior to each attempt at burner ignition for interrogating the control relay to determine the state of the control relay contacts; and second means enabled by an indication from the first means that the control relay contacts are in a position to enable the gas valve for disabling the burner, said second means including a circuit breaking means connected in circuit with a power supply to the burner control and means for actuating the circuit breaking means for thereby disabling the burner in response to a said indication from the first means that the contacts are in said position to enable the gas valve, said circuit breaking means being of a type other said control relay contacts, so as to reduce commonality of failure modes.

12. The burner control of claim 11 wherein the means for actuating the circuit breaking means comprises a gate which when enabled causes excessive current flow through the circuit breaking means from the power supply to ground.

* * * * *